United States Patent [19]

Schechter et al.

[11] Patent Number: 4,899,714

[45] Date of Patent: Feb. 13, 1990

[54] AIR/GAS FORCED FUEL INJECTION SYSTEM

[75] Inventors: Michael M. Schechter, Southfield; Martin Cloke, Orchard Lake, both of Mich.

[73] Assignee: Ford Motor Company, Dearborn, Mich.

[21] Appl. No.: 256,446

[22] Filed: Oct. 12, 1988

[51] Int. Cl.[4] ..... F02M 67/02

[52] U.S. Cl. ..... 123/533

[58] Field of Search ..... 123/531, 532, 533, 534, 123/179 L; 239/89

[56] References Cited

U.S. PATENT DOCUMENTS

| | | | |
|---|---|---|---|
| 2,710,600 | 6/1955 | Nallinger | 123/533 |
| 4,157,084 | 6/1979 | Wallis | 123/179 L |
| 4,381,077 | 4/1983 | Tsumura et al. | 239/89 |
| 4,462,760 | 7/1984 | Sarich et al. | 417/54 |
| 4,465,050 | 8/1984 | Igashira et al. | 123/472 |
| 4,554,945 | 11/1985 | McKay | 123/531 X |
| 4,693,224 | 9/1987 | McKay | 123/531 |
| 4,823,756 | 4/1989 | Ziejewski et al. | 123/531 |

FOREIGN PATENT DOCUMENTS

| | | | |
|---|---|---|---|
| 0231169 | 12/1984 | Japan | 123/533 |

*Primary Examiner*—Willis R. Wolfe

*Attorney, Agent, or Firm*—Robert E. McCollum; Clifford L. Sadler

[57] ABSTRACT

A fuel injection system includes an injector having a fuel and air/gas mixing chamber that includes a normally closed injector valve, the chamber being for premixing fuel and air, complete with controls to provide a time interval between introduction of the fuel into the air chamber and the introduction of compressed air/gas to cause the injection event by opening of the valve to permit evaporation of the fuel whereby a premixed rich air/fuel mixture charge is discharged into the engine combustion chamber.

16 Claims, 4 Drawing Sheets

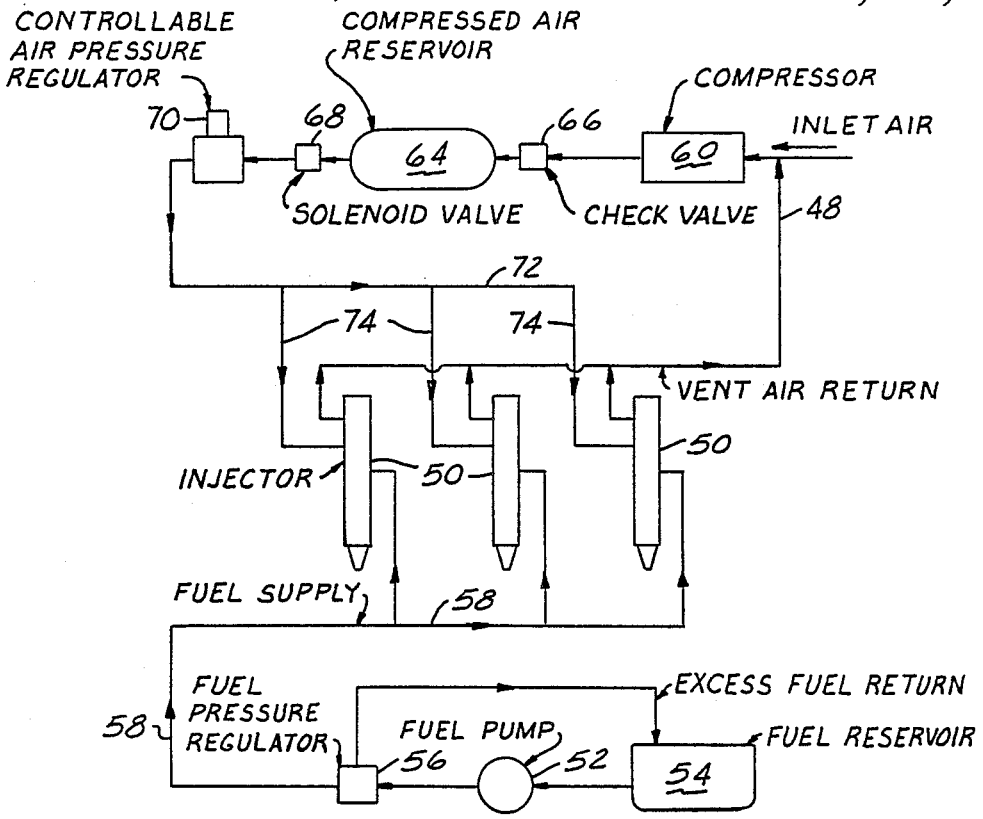
FIG.4
FIG.5
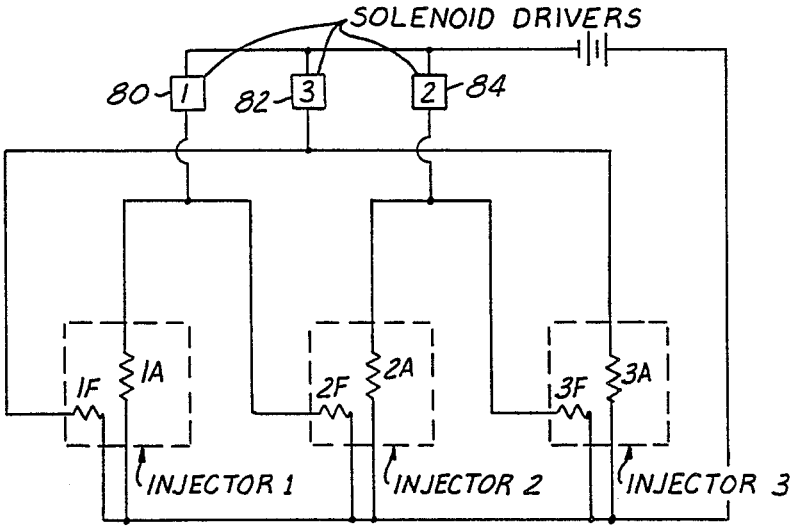

AIR/GAS FORCED FUEL INJECTION SYSTEM

This invention relates in general to a fuel injection system for an automotive type internal combustion engine. More particularly, it relates to the construction of a fuel injector in which fuel and air or gas are premixed in a chamber in the injector prior to being discharged into the engine combustion chamber, a dwell period being provided prior to the injection so that the fuel charge can be in contact with the gas for evaporation, resulting in a premixed, rich fuel/air charge that is injected with the fuel at least partially in a gaseous state.

It is one of the primary objects of the invention to provide a fuel injector construction in which compressed air is used as the high pressure source for the fuel injection event, and in which air and fuel are premixed prior to injection with a time delay prior to injection for evaporation of the fuel so that a rich air/fuel mixture charge enters the combustion chamber. It is another object of the invention to provide a fuel injection system in which engine cylinder compressed gas is utilized as the charging pressure medium to effect opening of the fuel injector to discharge a fuel/gas premixed mixture into the combustion chamber.

It is another object of the invention to provide an electrical control system for a fuel injector discharging a premixed charge into the engine combustion chamber that includes a number of driver circuits to effect the supply to gas/air and fuel to the respective injectors in a manner establishing a time interval between introduction of the fuel and the compressed gas/air and a subsequent discharging of the mixture into the combustion chamber.

The premixing of fuel and air or gas in an injection system is known. For example, Igashira et al, U.S. Pat. No. 4,465,050 discloses a manifold injector system including an air pump and a fuel pump which deliver their respective fluids to an injector having a single pulsed solenoid that controls only fuel flows, air being controlled by a separate valve. The air and fuel pulses are simultaneous, however, and their is no dwell period after the fuel and air areintroduced together to permit time for the fuel to evaporate before being injected into the engine.

McKay, U.S. Pat. No. 4,554,945, shows a construction in which fuel is first introduced into a metering chamber and then air is admitted by a solenoid and air pressure to close the fuel inlet and outlet parts. However, again, there is no mixing of the air and fuel with a timed delay sufficient to permit evaporation of the fuel and further mixing prior to injection into the engine.

Tsummura et al, U.S. Pat. No. 4,381,077, provides an injector wherein air is introduced simultaneously with fuel and these are combined in a mixing chamber wherefrom they are displaced by a piston. While there is a mixing and a dwell period, the mixture is not displaced by engine compressed gas or air admitted to evaporate the fuel during the mixing process, as is of this invention to be described.

Sarich, et al, U.S. Pat. No. 4,462,760, first fills a metering chamber with fuel and then displaces the fuel by means of pressurized gas. However, there is no dwell period for the evaporation of the fuel prior to subsequent injection into the engine.

None of the above references shows or discloses a fuel injector assembly in which a mixing chamber containing air or gas at ambient pressure is provided with a fuel inlet and a compressed air or gas inlet, and whereby a time delay is provided subsequent to fuel being introduced into the air or gas chamber to permit evaporation and mixing of the fuel, and thereafter the compressed air or gas source is admitted to eject the mixture into the engine combustion chamber.

None of the references also shows a charging valve assembly in which compressed gas from an engine cylinder during its compression stroke is utilized as the charging pressure for the ejection of the premixed fuel and air or gas in the injector assembly.

Furthermore, none of the references shows a fuel injection system in which a plurality of injectors are used, each of which combine fuel and air or gas in a mixing chamber and provide a timed delay before injection to permit fuel evaporation so that a premixed rich air/fuel charge is discharged into the engine.

Other objects, features and advantages of the invention become more apparent upon reference to the succeeding detailed description thereof, and to the drawings illustrating the preferred embodiments thereof, wherein:

FIGS. 4, 5, 7 and 8 are schematic illustrations of fuel injection systems supplying both fuel and air to individual fuel injector assemblies embodying the invention.

As stated previously, the invention relates to air or gas forced fuel injection systems for gasoline engines of the type in which electronically controlled devices, such as solenoid valves, are used as actuators for both fuel and air control. Other devices such as piezoelectric actuators, however, can be used instead of solenoids.

In brief, the fuel injection system to be described is intended primarily for direct fuel injection, although it is applicable to port injection. Compressed air, or cylinder compression gas in another embodiment, is used for fuel injection and atomization. However, one of the main features of the system is the fact that fuel charged metering and fuel injection are separated by a time interval during which the fuel charge is in contact with air or gas and can evaporate so that when the injection is made, a premixed, rich fuel/air charge is injected with the fuel at least partially in gaseous state. Important items in the system are a set of injectors, one per engine cylinder, which are usually installed directly in the cylinder head, and a set of charging valves, also one per engine cylinder, and also usually installed directly in the cylinder head. Fuel and compressed air or gas are supplied to each injector by separate fuel and air supply systems.

Figure 1:
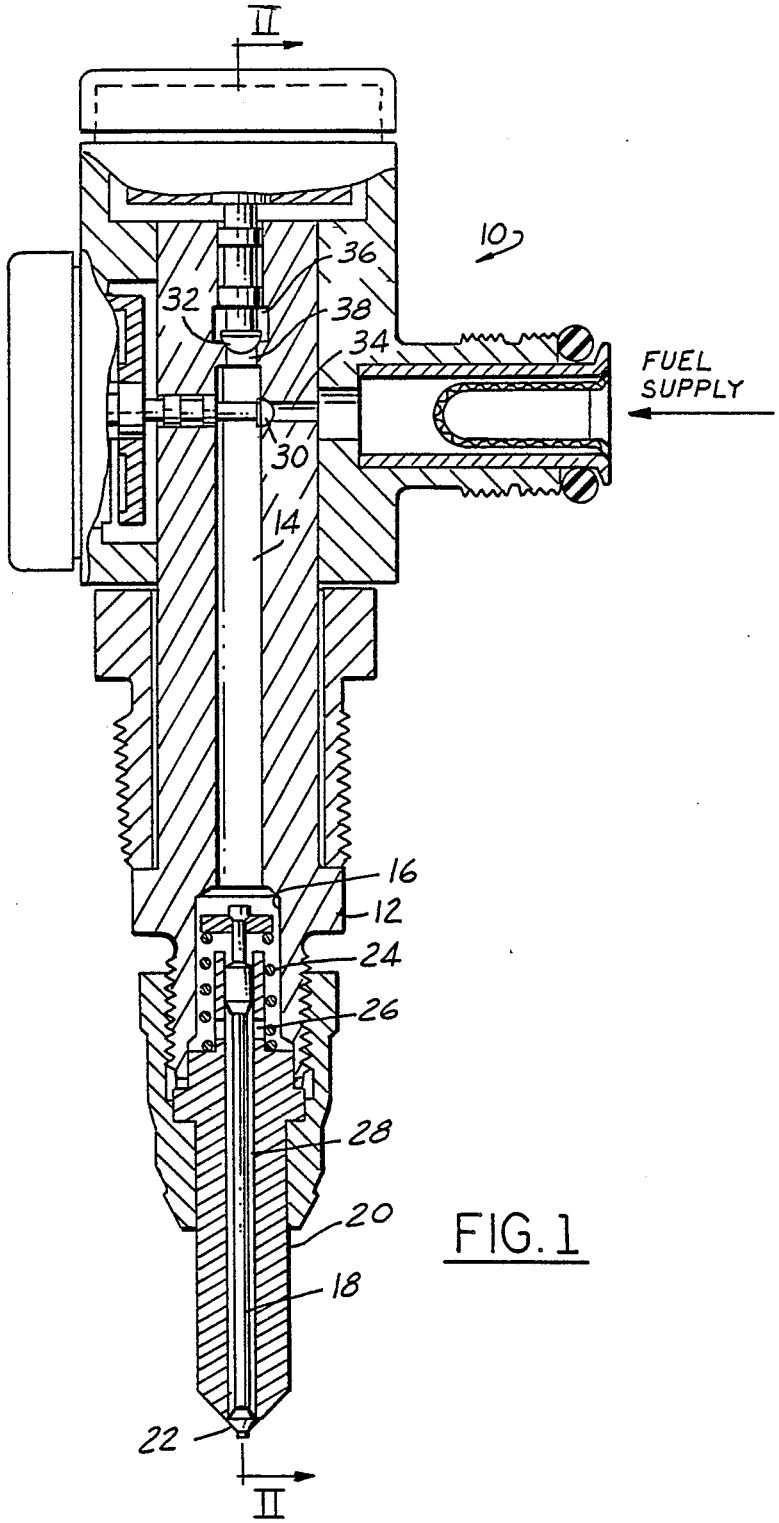
FIG. 1 is a cross-sectional schematic view of a fuel injector assembly embodying the invention.

More specifically, FIG. 1 shows a fuel injector assembly 10 that includes a shell or body 12 containing a central air/gas and fuel mixing chamber 14. The chamber extends longitudinally along the axis of the injector assembly and at its lower end is enlarged at 16 to contain a fuel injector valve 18. The valve reciprocates in a valve body 20 between open and closed positions, and has a nozzle or tip 22 seated against the body by a spring 24. Side ports 26 communicate the fuel/air mixture charge in mixing chamber 14 to the tip of the injector valve along the channel or passage 28 containing the stem of the valve.

Figure 2:
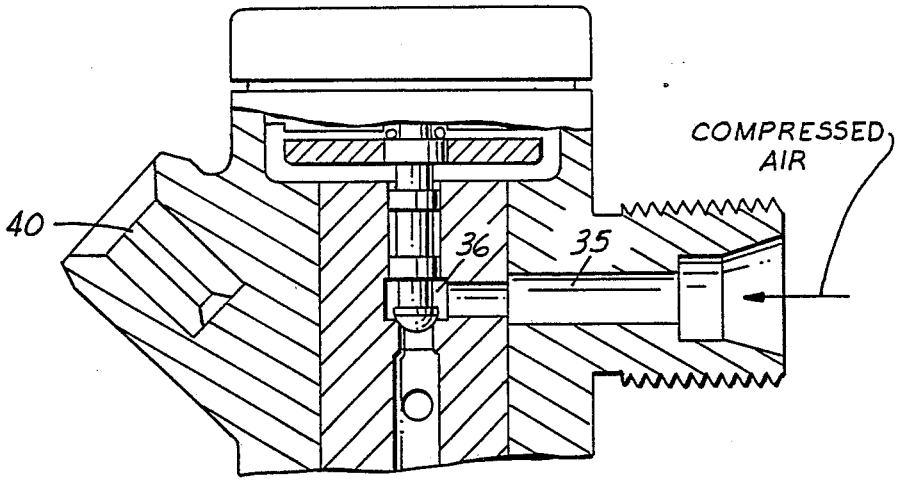
FIG. 2 is a cross-sectional view taken on a plane indicated by and viewed in the direction of the arrows II—II of FIG. 1.

The upper part of mixing chamber 14 is closed by a pair of normally closed, solenoid actuated poppet type valves 30 and 32. Valve 30 is a fuel control valve. It normally closes a supply passage 34 communicating with the mixing chamber 14 at one end and with a fuel supply, as indicated, at its other end. Valve 32 is an air control valve. It normally blocks the passage of compressed air from a passage 35 (FIG. 2) and a chamber 36 into the mixing chamber 14 through a connecting passage 38. FIG. 2 further illustrates an electrical input 40 to both the fuel and air solenoids.

Figure 3:
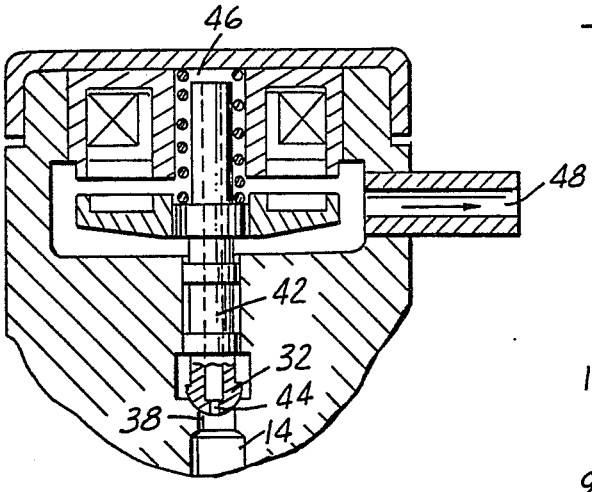
FIG. 3 is an enlarged cross-sectional view of a detail of FIG. 1.

The mixing chamber 14 always contains air. For this purpose, the mixing chamber 14 is vented to the outside so that its residual pressure always drops to a low level after the end of injection approximately equal to atmospheric pressure. More specifically, referring to FIG. 3, the air control valve 32 has an axial channel 42 extending along its length with a calibrated orifice 44 at its tip in communication with the passage 38 and chamber 14. Between injections, the channel 42 connects the mixing chamber 14 with the inside of the solenoid, which is vented to the outside through the space 46 between the top of the valve and the solenoid housing and around the valve stem and out a passage 48 to the intake of the air compressor or to the intake of the engine.

The solenoids in this case would be controlled by means of an electronic control system which supplies the solenoids with voltage signals of variable width and timing, the signals being fed through the connector 40 shown in FIG. 2. When the fuel valve 30 opens, fuel will be metered into the mixing chamber 14. The metered fuel quantity would be determined by the duration of fuel control valve opening, size of the orifice and the supply of fuel pressure. Usually, it would be controlled by controlling the solenoid Pulse width. After the introduction of the fuel into chamber 14, the fuel will stay in the air filled chamber for a substantial portion of the engine cycle. This provides a time interval in which the fuel is exposed to the air and can evaporate before the mixture is injected into the engine. It permits time for the fuel to penetrate the air in the chamber.

Therefore, when the air control valve 32 opens, a charge of compressed air fills the mixing chamber 14 to effect a further mixing and evaporation of the fuel by a penetration of the air into the fuel, but also opens the normally closed injector valve 22 to expel the premixed fuel/air charge past the valve tip. This is the fuel injection event or cycle. The timing of fuel injection can be controlled by controlling the timing of the air control solenoid pulse. Varying the compressed air pressure also can vary injection rate and fuel penetration. The injection ends when the air control solenoid or actuator is deactivated and the air control valve 32 closes.

As stated previously, after the end of injection, the mixing chamber 14 will be vented to the outside to the intake of the air compressor or to the intake of the engine through the calibrated orifice 44 in the air control valve 32 and therefrom through the vent passage 48. This once again conditions the mixing chamber 14 filled with air at ambient or atmospheric pressure level.

FIG. 4 shows schematically an overall diagram of a compressed air and fuel supply arrangement for a system having three injectors 50. A fuel pump 52 draws fuel from a reservoir 54 and delivers it under pressure through a pressure regulator 56 to a common fuel rail 58 to which all three of the injectors 50 are connected. At the upper part of the diagram or drawing, a compressor 60 draws atmospheric air through an intake 62 and pumps it under pressure into a compressed air reservoir or accumulator 64. A check valve 66 on the inlet and a solenoid valve 68 on the outlet, which is open only during engine operation, maintain the air pressure in reservoir 64 when the engine is not running. During engine operation, compressed air would be discharged from the reservoir 64 through the open solenoid valve 68 and supplied under pressure through a controllable pressure regulator 70 to a common air supply rail 72 to which all three injectors 50 are connected in parallel by connecting line 74. Varying the air pressure in the common rail 72 will vary the fuel injection rate and fuel spray penetration, as described previously in connection with the embodiment shown in FIGS. 1–3. The vented air in air control valve 32 would be returned to the inlet to the compressor by the line 48.

The three injectors in this case are controlled by an electronic control system that would receive the operator's demand signal and determine the needed solenoid voltage pulse width and timing necessary to supply the engine with the required fuel quantity at the right time in the engine cycle. A voltage pulse of proper duration and timing would be sent to each solenoid and, in principle, each solenoid would require a separate driving circuit. It is possible, however, to reduce the number of driving circuits by using a single solenoid driver to drive two solenoids simultaneously. An example of such an arrangement is shown diagrammatically in FIG. 5 where three solenoid drivers 80, 82, 84 are used to drive six solenoids, 1F, 2F, 3F, 1A, 2A, 3A. Each of the drivers 80, 82, 84 would drive an air controlled solenoid 1A, for example, in one injector and a fuel controlled solenoid 2F in another one. Assuming that the working order of the injectors would be 1-2-3, activation of driver 80 would energize solenoids 1A and 2F, which results in a fuel injection in injector No. 1 and a fuel metering event in injector No. 2. Subsequent activation of driver 82 would energize solenoids 2A and 3F, resulting in injection from injector No. 2 and fuel metering in injector No. 3. Activation of driver 84, therefore, leads to injection from injector No. 3 and metering in injector No. 1. It will be clear, therefore, that the dwell between the injection of the fuel and the opening of the air control air compressor valve is clearly provided for.

The solenoid valves would be designed so that the minimum pulse width necessary for the air controlled solenoid would never be shorter than the required fuel controlled solenoid pulse. In the arrangement just described above, the time interval between fuel metering or entering into the chamber 14 and the fuel injection event in each injector would be equal to one-third of the cycle. It is clear, however, that with a slightly different arrangement, this timed interval could be two-thirds of the cycle, for example, thus giving the fuel more time for evaporation in the mixing chamber 14. For this, the pairs of simultaneously energized solenoid actuators should be: 1A and 3F, 2A and 1F, 3A and 2F. It is clear, also, that each pair of simultaneously energized solenoids could be connected in series, rather than in parallel, as shown.

In a multicylinder engine, it is desirable to deliver equal fuel quantities to all cylinders. The fuel quantity metered by the fuel control solenoid valve is determined by the fuel flow rate through the valve orifice and the duration of the valve opening.

$$Q=qt \quad (1)$$

where:

Q=fuel quantity in mg q=fuel flow rate in mg/ms t=duration of valve opening in ms The flow rate q is a function of the orifice area and the pressure differential across the orifice. If the orifices in all solenoid valves are made with very high accuracy, their areas are equal. In a given system, the pressure differentials are also equal for all orifices. In such a system q can be considered a system constant. The duration of valve opening t is a function of the solenoid control pulse width.

$$t=t_c-t_a+t_c \quad (2)$$

where:

t=duration of valve opening in ms $t_c$=solenoid control pulse in ms $t_a$=valve opening delay in ms $t_d$=valve closure delay in ms From equation (2) the algorithm for control pulse is:

$$t_c=t+t_a-t_d \quad (3)$$

If the value opening and closure delays were identical in all solenoids, equal control pulse widths in all solenoids would result in equal fuel deliveries to all cylinders. However, due to unavoidable variations in manufacturing tolerances, the values of delays $t_a$ and $t_c$ vary from solenoid to solenoid. As a result, equal control pulses in all solenoids produce different fuel quantities in different engine cylinders. This situation can be improved if the control pulse width $t_c$ in each solenoid is individually tailored to achieve the required fuel delivery in spite of the solenoid-to-solenoid scatter in valve opening and closure delays. For this, the algorithm for solenoid control pulse is modified as follows:

$$t_c=t+t_s+t_x \quad (4)$$

where:

$t_c$=solenoid control pulse t=required duration of valve opening $t_s=(t_a-t_d)\min$=minimum value of net opening and closure delays which is constant $t_x$=correction term The values of t and $t_x$ are the same for all fuel control solenoids for a given fuel quantity demand. The value of correction term $t_x$ is, in principle, different for each solenoid and is selected so as to assure equal fuel delivery to all cylinders. The value of the correction term $t_x$ for each individual injector can be determined experimentally during injector bench testing and encoded on the injector in the form of a number, which can be called the injector characteristic number. The controller reads the value of the correction term $t_x$ and for a given value of required fuel quantity Q determines the required control pulse $t_c$ from the following algorithm:

$$t_c=Q/q+t_s=t_x$$

In many cases, the accuracy with which the control orifices in the solenoid valves are made is not high enough, and the solenoid-to-solenoid differences in orifice areas cannot be disregarded. In this case, the fuel flow rate q in equation (1) cannot be considered a system constant. It varies from injector to injector as a direct function of orifice area. In such a case, the above described single point calibration of injectors is inadequate, since the slope of injector characteristic expressed by equation (1) varies from injector to injector, and calibration for equal fuel delivery at one point cannot quarantee equal deliveries at other points. To achieve equal deliveries in all injectors at all points of the fuel flow vs. valve opening time characteristic, the equation (1) can be modified as follows:

$$Q=Kqt \quad (6)$$

where:

Q=fuel quantity in mg q=individual injector flow rate in mg/ms t=duration of valve opening in ms K=correction factor The value of the correction factor K is, in principle, different for each injector and is selected so that the product Kq is the same in all injectors. This assures equal slopes in all injector characteristics and permits subsequent single point calibration. For practical reasons, the values of K should be always larger than one (or always less than one). The value of the correction factor K for each individual injector can be determined experimentally during injector bench testing and encoded on the injector as part of the same characteristic number which contains information on the connection term $t_x$. The controller reads the values of both the correction term $t_x$ and the correction factor K and, for a given value of required fuel quantity Q, determines the required control pulse $t_c$ from the following algorithm.

$$t_c=Q/Kq+t_s+t_x \quad (7)$$

The manner in which the characteristic number is encoded should permit easy transmission of information on the number to the electronic controller. For this, the injector can be equipped with a memory device in which the value of the characteristic number is retained and can be "read" by the controller. A microchip memory would be suitable for this purpose, but, since only one number has to be stored, much simpler devices can be used.

Since each fuel control solenoid is usually driven by a separate power transistor driver, cylinder-to-cylinder fuel maldistribution may also be the result of differences between individual solenoid drivers. This deficiency can be corrected in the same manner as in the case of differences between solenoids. An additional correction term accounting for the deviation in the characteristic of the driver is introduced into the fuel delivery algorithm, an individual characteristic number is encoded on each driver, and the controller reads the characteristic numbers of all the drivers as well as solenoids and makes proper adjustments in control pulse widths.

Figure 6:
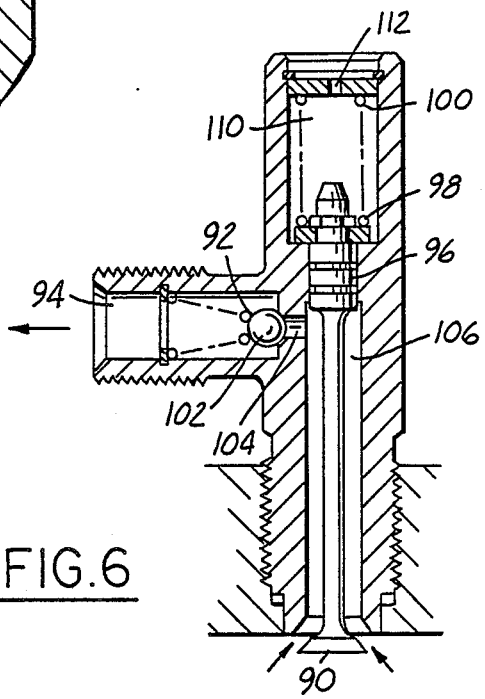
FIG. 6 is a cross-sectional view of a gas charging assembly for use with the construction shown in FIG. 1.

The FIGS. 1–5 embodiment show the use of compressed air to perform the injection of the fuel/air mixture into the engine. FIG. 6 shows a charging valve assembly in which engine gas compressed in the engine cylinders during the compression strokes is used to perform the injection of fuel for improved fuel atomization or both, instead of the compressed air in the FIGS. 1–5 embodiment. More specifically, the purpose of each charging valve is to tap the pressure generated in the cylinder during the compression stroke and charge the compressed gas supply system to the predetermined maximum pressure. In the most elementary case, the compressed gas supply system would simply consist of lines connecting each charging valve with one of the injectors.

FIG. 6 shows an example of a charging valve assembly. The assembly actually includes two valves, a normally opened pressure limiting valve 90, and a normally closed check valve 92 that leads to a line 94 connecting the valve to the compressed gas supply system for the injectors. The pressure limiting valve 90 is of the poppet type having an upper land 96 sealingly secured to a spring seat 98 for a spring 100. The spring would normally maintain the valve 90 open below a predetermined cylinder compression gas pressure level. The check valve 92 could be of a known construction and operation having a spring pressed ball 102 closing the passage 104 communicating with the channel or chamber 106.

During the compression stroke, the pressure limiting valve 90 would initially be open, and as soon as the pressure in the engine cylinder exceeds the residual pressure in the compressed gas supply system, the cylinder pressure would open check valve 92 and the gas supply system would be charged by the engine compression gas to a maximum pressure determined by the preload of the spring 100. When the maximum pressure in the system is reached, the pressure force acting on the piston or land 96 of the pressure limiting valve 90 would overcome the force of the spring 100 and close valve 90. It would reopen again in the later part of the expansion stroke when the pressure force acting on the pressure limiting valve drops below the preload of the spring 100. The volume above land 96; i.e., the chamber 110 containing the spring 100, is vented to the outside through a vent 112. In some cases, this volume may have to be connected to the engine intake. It should be noted that, in principle, the charging valve can be without the pressure limiting valve 90. In that case, however, the gas supply system would be charged with hot combustion gas.

Figure 7:
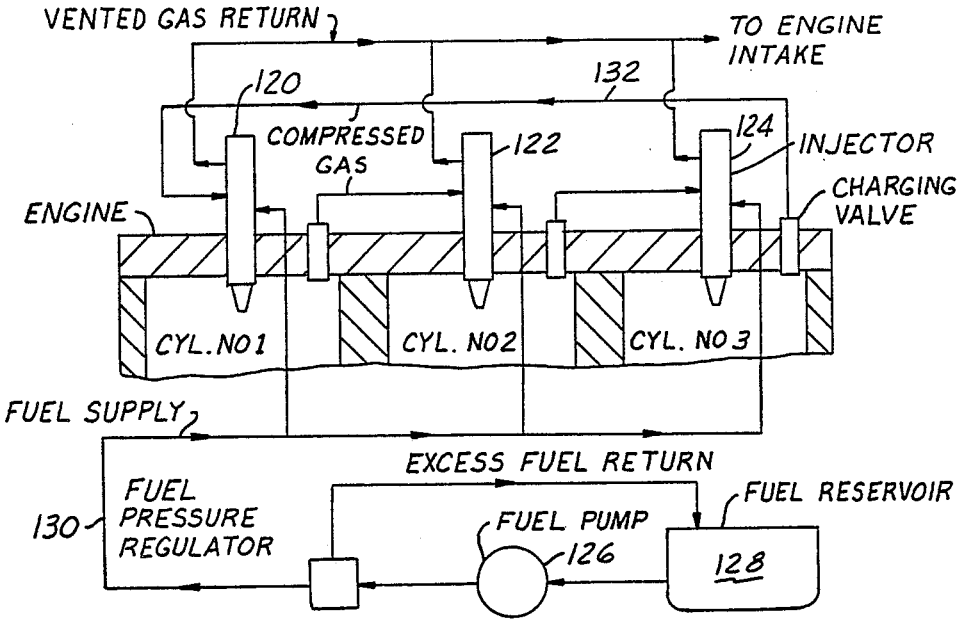

While there are several ways in which the gas forced injection system could be arranged, one is shown diagrammatically in FIG. 7 for a three-cylinder engine. Fuel and compressed gas would be supplied to the three injectors 120, 122, and 124 by two separate systems. In the fuel supply system, a fuel pump 126 would draw fuel form a reservoir 128 and deliver it under pressure to a common fuel rail 130 to which all three injectors are connected. In the compressed gas supply system, a gas line 132 from one of the charging valve assemblies described in connection with FIG. 6 would connect each injector with one of the charging valves 90. The volume of each line should be sufficient to store enough compressed gas to perform at least one fuel injection event. In a given cylinder, the injector would be connected with the charging valve installed in a cylinder preceding the given cylinder in the firing order. In an example depicted in FIG. 5, the firing order of the cylinders is 1-2-3; and, thus, the charging valve in cylinder one would feed compressed gas to the injector in cylinder two, while the charging valves in cylinders two and three would feed gas to injectors in cylinders three and one, respectively. The gas vented from all the injectors would be returned to the engine intake, as indicated.

Figure 8:
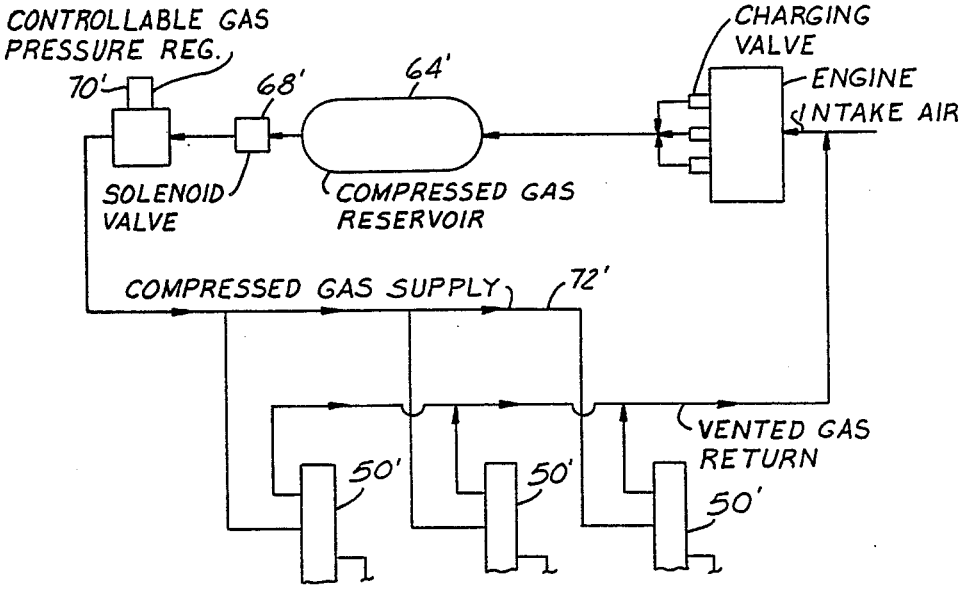

Another example of a gas forced injection system is shown in FIG. 8, which is essentially the same as that shown in the FIG. 4 embodiment, except for the supply of gas to the reservoir 64'. In this case, all three injectors receive compressed gas from a common rail gas supply system, rather than air. The charging valves in all the engine cylinders would feed compressed gas into a common compressed gas reservoir 64'from where it could be discharged through a solenoid valve and a controllable gas pressure regulator into the common gas supply rail 72'. The solenoid valve would be open only during engine operation and, therefore, gas pressure in the reservoir would be maintained even when the engine is not running. The system operates otherwise as described in connection with the embodiment shown in FIG. 4.

A system similar to the one described above could be used also to improve fuel atomization. Fuel injection systems in which improved fuel atomization is achieved by injecting compressed air into a stream of fuel exiting and injection nozzle are widely known and used. Their usage in reciprocating internal combustion engines is limited due to additional cost associated with the need for an air compressor. Using compressed engine gas supplied to fuel injectors in any of the manners described above permits realization of compressed gas assisted fuel atomization without a compressor.

While the invention has been shown and described in its preferred embodiments, it will be clear to those skilled in the arts to which they pertain, that many changes and modifications may be made thereto without departing from the scope of the invention.

We claim:

1. An apparatus for injecting a slug of air mixed with partially evaporated fuel into an engine comprising:

a fuel injector body having an air inlet, a fuel inlet, and an actuatable normally closed fuel/air outlet, means connecting the air inlet to air at ambient pressure, means connecting the fuel inlet to a source of fuel under pressure for mixing with the ambient air in the body for penetration thereinto and for partial evaporation of the fuel, and means for admitting air under pressure to the air inlet subsequent to admission of the fuel to the body and after a time delay therebetween for further penetration of the air into the fuel and evaporation thereof and for an actuation of the outlet to open for ejection of the fuel/air through the outlet.

2. A fuel injector assembly including a longitudinally extending hollow body having:

an axially extending main fuel/gas mixing chamber initially containing a gas at essentially ambient pressure level and having a movable control valve spring biased to a position normally closing one end of the chamber as well as an outlet from the body and actuatable by a fuel/-gas mixture to an open position to permit ejection of the fuel/gas mixture from the chamber and body, a first source of fuel and a second source of gas each under pressure and each separably connectible through the body to the other end of the chamber, and selectively operable electrically controlled valve means movable between open and closed positions controlling admission of each of the sources to the chamber in a manner to first admit fuel to the chamber for mixing with the gas therein and after a time delay admitting additional gas to the chamber under sufficient pressure to further mix the fuel and gas in the chamber and move open the control valve to eject the mixture from the chamber and body.

3. An assembly as in claim 2, the selectively operable valve means including an electromagnetically operated gas flow control valve movable between open and closed positions in a gas passage for controlling the flow therethrough, the passage opening at one end into the chamber and being connected at its other end to the second source of gas under pressure, a second passage connected at one end to a vent at essentially an ambient pressure level and at its other end to the valve, the valve having a restricted opening therethrough permitting communication between the chamber and the second passage and vent at all times regardless of the closed position of the valve to thereby vent the chamber to ambient pressure level when the selectively operable valve means and control valve are closed.

4. A fuel injection system comprising, in combination, a plurality of individually sequentially operable fuel injectors, each injector having a fuel/gas mixing chamber with fuel and gas inlets thereto and a mixture outlet therefrom normally blocked by a spring closed pressure opened valve, a source of fuel under pressure, a source of gas under pressure, means venting the chamber to ambient pressure prior to the inlet of fuel thereto, first solenoid control means connecting the fuel source to each injector gas inlet, and electrically operated means controlling the energization of the solenoid means to selectively apply the fuel and gas to each injector in a manner providing a timing delay between introduction of the fuel into the injector and introduction of the gas under pressure, to permit penetration of the fuel into the gas in the chamber for evaporation of the fuel prior to ejection of the fuel/gas mixture past the valve upon admission of the gas under pressure to the chamber, the electrically operated means including a plurality of individual selectively energizable solenoid drivers, and circuit means each connecting each driver to at least one of the first solenoid control means for the fuel source for one injector and simultaneously to the second solenoid control means for the gas source for another of the injectors, the drivers being operated individually in sequence to establish the desired timing delay.

5. A system as in claim 4, wherein the circuits connecting each driver to its respective first and second solenoid control means are in parallel.

6. A system as in claim 4, wherein the circuits connecting each driver to its respective first and second solenoid control means are in series.

7. A method of supplying and discharging a fuel and gas mixture into and from an automotive type fuel injector that is biased to a closed position comprising the steps of, first, connecting a central chamber in the injector to gas at ambient pressure level; secondly, supplying the chamber with fuel to mix with the gas to form at least a partially combustible mixture charge; thirdly, holding the fuel/gas mixture charge in the chamber for a substantial duration of the engine cycle of rotation to promote evaporation of the fuel and further mixing of the fuel and gas; and, fourthly, applying further gas to the chamber at a sufficient pressure level to enhance penetration of the gas into the fuel and evaporation of the fuel and a subsequent discharge of the fuel/gas mixture charge from the injector.

8. A method as in claim 7, wherein the gas under pressure supplied to the chamber is engine cylinder compression gas.

9. A method as in claim 7, the second step including admitting fuel under pressure to the chamber in a quantity metered in accordance with engine operating parameters for penetration into the gas and evaporation of the fuel.

10. A method as in claim 9, including, fifthly, venting the chamber to an ambient pressure level subsequent to cessation of supply of the gas under pressure to the chamber and a closing of the selectively operable means.

11. A fuel injector assembly including a hollow body having:

a main fuel/gas mixing chamber open at both ends and initially containing a gas at essentially ambient pressure, a control valve normally closing one end of the chamber as well as an outlet from the body and actuatable to an open position to permit ejection of a fuel/gas mixture from the chamber and body, a first source of fuel and a second source of gas under pressure each separably connectible through the body to the other end of the chamber, and selectively operable means movable between open and closed positions for controlling admission of each of the sources to the chamber, the latter means being movable in a manner to first admit fuel to the chamber for mixing with the gas therein and after a time delay admitting the gas under pressure to the chamber to further mix the fuel and gas in the chamber and move open the control valve to eject the mixture from the chamber and body.

12. An assembly as in claim 11 wherein the gas under pressure is compressed air.

13. An assembly as in claim 11, wherein the means for admitting gas under pressure to the inlet includes means connecting compressed gas from an engine cylinder to storage means for storing gases at a predetermined pressure level, and passage means containing at least one of the selectively operable valve means connecting the storage gases to the inlet as a function of the operability of the valve means.

14. An assembly as in claim 13, the source of gas under pressure including a charging valve assembly for charging the storage means with pressurized gas from the engine cylinder, the assembly including a first gas passage connecting the engine cylinder containing gas under pressure to the storage means, a normally open, gas pressure closed pressure limiting valve in the first gas passage and movable from the open poistion to a closed position in response to the attainment of a predetermined pressure level in the first gas passage thereagainst to limit the pressure level in the first gas passage, and check valve means in the first gas passage between the storage means and pressure limiting valve for maintaining a predetermined pressure level in the storage means for subsequent introduction into the injector mixing chamber.

15. An assembly as in claim 14, including spring means biasing the pressure limiting valve to an open position, the latter valve having land means thereon actuatable by the cylinder gas pressure in a direction in opposition to the force of the spring means to close the pressure limiting valve.

16. An assembly as in claim 15, wherein the land means of the limiting valve and the check valve are in a parallel flow relationship in the first gas passage whereby the check valve is opened prior to closing of the limiting valve as soon as the residual pressure acting against the check valve from the storage means is less than the charging gas pressure from the engine cylinder.

* * * * *